United States Patent [19]

Schröck

[11] 4,306,442

[45] Dec. 22, 1981

[54] RADIAL PRESS FOR CYLINDRICAL WORKPIECES

[76] Inventor: Peter Schröck, Siegewerstr. 44, D-6230 Frankfurt am Main, Fed. Rep. of Germany

[21] Appl. No.: 81,401

[22] Filed: Oct. 3, 1979

[30] Foreign Application Priority Data

Oct. 12, 1978 [DE] Fed. Rep. of Germany ..... 2844475

[51] Int. Cl.[3] ..... B21D 41/00

[52] U.S. Cl. ..... 72/402; 29/237; 72/453.03

[58] Field of Search ..... 72/402, 367, 452, 453.03; 29/237, 517

[56] References Cited

U.S. PATENT DOCUMENTS

| | | | |
|---|---|---|---|
| 1,782,219 | 11/1930 | Wallace | 72/402 |
| 3,762,209 | 10/1973 | Herndon | 72/402 |
| 3,851,514 | 12/1974 | Chen | 72/402 |
| 3,879,834 | 4/1975 | Johnson | 29/237 |
| 4,014,202 | 3/1977 | Van Allen | 72/402 |
| 4,071,936 | 2/1978 | Smith | 29/237 |
| 4,107,964 | 8/1978 | Smith | 29/237 |

FOREIGN PATENT DOCUMENTS 2214339 8/1976 Fed. Rep. of Germany .

*Primary Examiner*—Gene P. Crosby

*Attorney, Agent, or Firm*—Sprung, Felfe, Horn, Lynch & Kramer

[57] ABSTRACT

A radial press for workpieces with cylindrical outer surfaces has a plurality of pressing jaws arranged in a circle for radial movement towards the axis of the workpiece outer surface. A pressure ring acts on the pressing jaws so that when the pressure ring is axial displaced, the jaws will open and close. Both the pressure ring and the pressing jaws each have two surface parts, having a wide setting angle and two surface parts having a narrow setting angle, wherein the surface parts having a wide setting angle are disposed firstly at the end faces and secondly between the surface parts having the narrow setting angle. In this way, when the pressing jaws are closed, the surface parts having the wide setting angle are deployed first, and then the surface parts having the narrow setting angle are deployed.

8 Claims, 4 Drawing Figures

RADIAL PRESS FOR CYLINDRICAL WORKPIECES

BACKGROUND OF THE INVENTION

The invention relates to a radial press for workpieces with cylindrical outer surfaces, particularly for securing fittings consisting of a sleeve and nipple to flexible pipes by mechanically altering the shape of the sleeve from that of the flexible pipe located between the nipple and the sleeve, which press consists of: a plurality of pressing tools which are arranged in a circle, are radially movable towards the outer surface of the workpiece and have outer surfaces, the generatrices of which extend towards the axis at an angle other than 90 degrees; a pressure ring which co-operates with the outer surfaces, is axially displaceable relative to the outer surfaces, and has a complementary inner surface; an axially extending backing member for the pressing tools; and a pressure-medium drive for imparting radial movement to the pressing tools.

In radial presses of this kind, the pressing tools execute a radial stroke, which is determined by the setting angle of the inner surface of the pressure ring in relation to the axis of the workpiece, as well as by the axial stroke of the pressure ring. However, these values cannot be varied to the required extent. The required radial pressing force is determined by the deformability of the workpiece. Although a very sharp setting angle of the slide facer of the pressing tools and the pressure ring results in low pressures in the hydraulic fluid because of the high transmission ratio necessitated thereby, a long axial stroke of the pressure ring is rendered necessary. For a given cross-section of the piston of the pressure-medium drive, this in turn calls for a large delivery capacity of the pump system accompanied by suitable selection of the flow cross-sections. On the other hand, the cycle would extend over unacceptably lengthy periods. Although, with a wide setting angle of the slide faces of the pressing tools and the pressure ring, the radial stroke of the pressing tools would be longer and the axial stroke of the pressure ring shorter, the changed transmission ratio requires higher pressure in the hydraulic system.

For certain applications, for example for connecting fittings to high-pressure flexible pipes, a long radial stroke by the pressing tools is necessary in order, for example, to permit fittings having a large diameter of connecting flange and/or a curved tubular connector to be introduced into the radial press. On the one hand, this determines the radial stroke of the pressing tools that is needed; on the other hand, the required radial pressure forces, in conjunction with the need for the lowest possible maximum pressure in the hydraulic system, determine the setting angle of the slide faces of the pressing tools and the pressure ring, which angle should be as sharp as possible in relation to the axis of the outer surface of the workpiece. The requirements imposed lead to diametrically opposed design solutions. The most appropriate solution would be to design a pressure ring, the setting angle of the inner surface of which is sharp, and which is capable of executing a correspondingly long axial stroke. Here, it has to be borne in mind that the stroke of the pressure ring as far as the point at which the pressing tools are applied to the workpiece would be an idling stroke for the most part, whereas the delivery capacity of the required hydraulic pump would have to be rated to suit the remaining part of the stroke known as the working stroke. Because of the necessarily large delivery volume during the idling stroke, either unacceptably lengthy times for carrying out the cycle or correspondingly large hydraulic pumps and flow cross-sections would be necessary. The normal delivery capacity for a radial press for connecting flexible pipe fittings having an outside diameter of 90 mm is in the order of 70 liters per minute.

DE-PS No. 22 14 339 has disclosed a solution to the problem in question which consists in making the pressure ring for the pressing tools axially displaceable independently of the pressure-medium drive. In this known case, the pressure ring is rendered axially displaceable by arranging it in a press frame in which it can be moved by hand with the aid of a screw-thread. For the purpose of introducing a fitting for a flexible pipe, the movable part of the press frame is first displaced hydraulically as far as the stop, whereafter the pressure ring is screwed out by hand until the pressing tools reach their extreme outer position. This procedure is repeated in reverse when establishing the connexion between the fitting and the flexible pipe. The known solution has given excellent results when used for repairs wherein a low total weight of equipment takes precedence over short cycle times. The known radial press is less suitable for full-scale production processes.

For the purpose of facilitating the introduction of fittings and flexible pipes, radial presses for full-scale production purposes have also been designed wherein the press as such is radially divided and the two parts are hinged to each other. However, this results in a reduction in the strength of the important components of the press. In particular, the front plate of the press, which must also take up the reaction forces of the entire press frame, has to be slotted, and this necessitates a complicated construction for enabling the necessary strength to be provided. Because of the need for swinging up the press tool when loading the press, valuable time in the production process is furthermore lost.

SUMMARY OF THE INVENTION

The object of the present invention is to provide a radial press of the initially described kind which, without requiring additional handling, enables the pressing tools to execute a long radial stroke while requiring a hydraulic system of only small delivery capacity.

According to the invention, this object is achieved in the case of a radial press of the initially described kind in that the outer surfaces of the pressing tools as well as the complementary inner surfaces of the pressure ring are composed of surface parts having different setting angles of the generatrices relative to the axis, such that, in the closing direction of the pressing tools, first surface parts having a wide setting angle $\alpha$ and then surface parts having narrow setting angles $\beta$ are in contact with each other.

In contrast with the prior art, the outer surfaces of the pressing tools as well as the complementary inner surface of the pressure ring are stepped and have different angles relative to the axis of the workpiece and the axis of the press. During the idling stroke, the surface part or surface parts having a wide setting angle are first used, i.e. the pressing tools execute a long radial stroke, resisted only by the return springs, while the pressure ring executes a short stroke. The point of change-over from the wide setting angle to the narrow or sharp setting angle is so arranged that the sharp setting angle becomes effective when the idling stroke is completed and the power stroke comes into effect. The delivery volume of hydraulic fluid and therefore the time over which the cycle of the radial press extends are extremely small. The sharp setting angle of the surface parts used during the power stroke can be so selected in relation to the maximum hydraulic pressure that in addition to a saving in the delivery volume, a lower rating of the entire hydraulic system is possible. It has been found when applying the teaching of the invention and in the case of a radial press for connecting fittings of the above-stated dimensions to flexible pipes that it is possible to reduce the delivery capacity of the hydraulic system to 15 liters per minute, i.e. to about $1/5^{th}$ of the previously known value. No manual intervention at all is necessary; the pressure ring shaped in accordance with the invention automatically controls the pressing tools so that a short cycle time results. The radial press in accordance with the invention is consequently very suitable for full-scale production purposes. Because of the more than average long radial total stroke of the pressing tools, that is made up of the idling stroke and the power stroke, it is likewise unnecessary for the apparatus to be divided or divisible in a radial plane, so that enclosed structural elements of great rigidity can be used.

A particularly advantageous mode of operation of the apparatus of the invention can be achieved if the pressure ring as well as the pressing tools each have two surface parts having a wide setting angle $\alpha$ and two surface parts having a narrow setting angle $\beta$, the surface parts having a wide setting angle $\alpha$ being disposed, firstly at the end faces and, secondly, between the surface parts having a narrow setting angle $\beta$, wherein the generatrices are of substantially equal length.

As a result of this principle of construction, the force-application point of the surface parts having a wide angle that act upon each other lies approximately midway along the axial extent of the pressing tools during the idling stroke, so that these tools can be moved largely without tilting. After completion of the idling stroke, each two pairs of surface parts having a narrow setting angle become effective, the total of their axial extents corresponding approximately to the total axial extent of the pressing tools. This also prevents tilting of the pressing tools to any great extent even when the pipe fitting to be compressed has not been inserted over its entire length in the pressing tools because of an error on the part of the operator, for example.

Particular advantage accrues if all the surface parts are conical, since this makes them particularly easy to produce. The pressing tools are produced by dividing up, at equidistant points, a ring, the outer surface of which consists of four frusto-conical portions, i.e.—starting from the larger face surface—of a frusto-conical portion having a sharp generating angle, a frusto-conical portion having a wide generating angle, and then a frusto-conical portion with a sharp generating angle and, finally, a frusto-conical portion having a wide generating angle.

It is particularly advantageous for the pressing tools to be connected to the axial backing member by way of radial dovetail guides so as to eliminate any possible displacement of the pressing tools in the circumferential direction by, for example, different characteristics in the return springs and/or the effects of gravity.

Also in accordance with the invention, a construction which is particularly compact in the axial direction can be achieved if the pressure ring is constituted by an annular piston and is surrounded by an annular cylinder, to which the axial backing member is secured in the closing direction of the pressure ring. The resultant reduction in the length of the entire apparatus enables fittings for flexible pipes that are of substantially asymmetrical shape to be dealt with. Furthermore, the operation of inserting the workpieces can be observed very clearly even from the rear side.

The construction and operating principles can also be reversed by fixing the location of the pressure ring and making it the closure member for the cylinder, and by making the backing member movable as part of the annular piston. In this arrangement, the pressure ring and the cylinder chamber are disposed one behind the other in the axial direction so that an arrangement of smaller diameter is achieved.

The subject-matter of the invention can be used not only for connecting fittings to flexible pipes but also, for example, for producing what are known as cable thimbles.

Three forms of construction of the subject-matter of the invention and their mode of operation will now be described in greater detail by reference to the accompanying drawings, wherein:

DETAILED DESCRIPTION OF THE INVENTION

Figure 1:
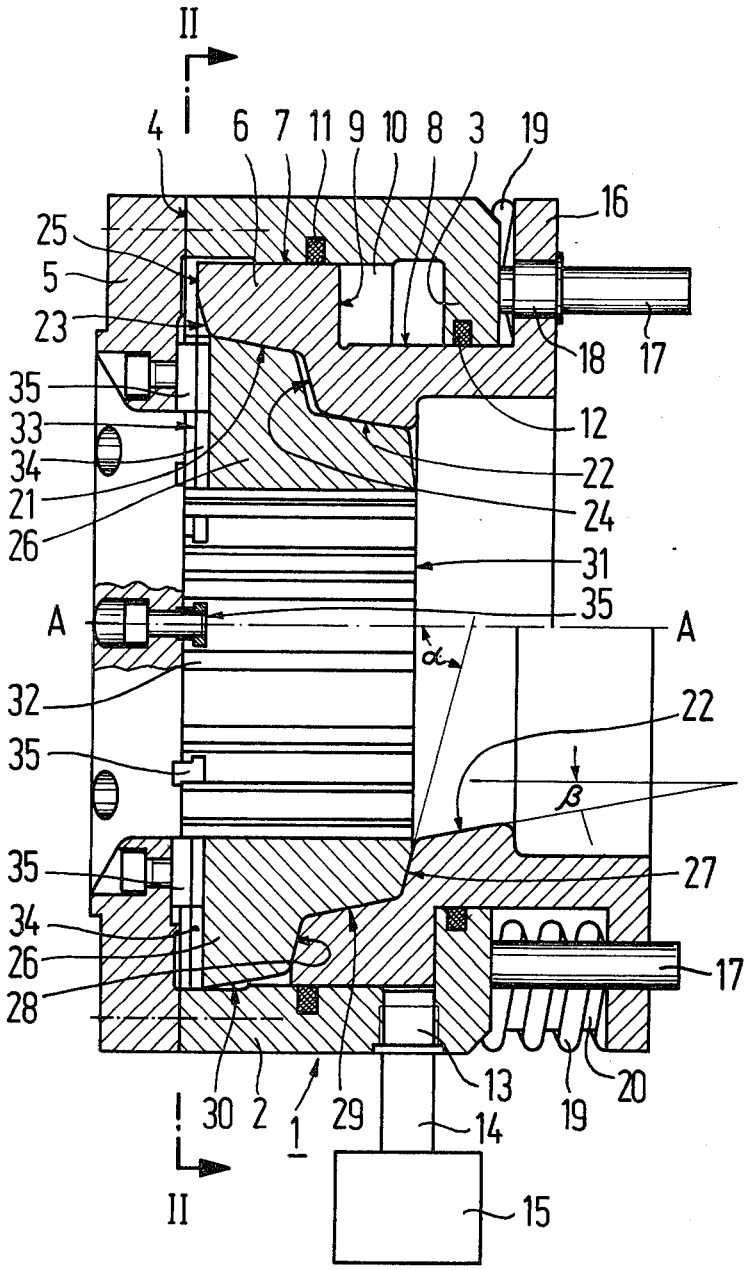
FIG. 1 is a section along the axis of a complete radial press in which the pressure ring also forms a hollow piston, this section being drawn along line I—I of FIG. 2.

FIG. 1 shows the cylinder 1 which consists of a cylindrical wall 2 and a radial flange 3. At that end face 4 remote from the flange 3 is secured a backing member 5 in the form of a substantially rectangular plate.

Within the cylinder 1 is located an axially symmetrical pressure ring 6, the outer surface of which consists of two cylindrical faces 7 and 8 of different diameters, between which is disposed an annular face 9 which forms the actual operating face of an annular piston which is formed by the pressure ring 6. The chamber 10 within the cylinder 2 is sealed off from the exterior by two O-rings 11 and 12. The cylinder chamber 10 communicates with a pressure-medium drive 15 by way of a bore 13 and a hydraulic pipe 14.

On its outer side the pressure ring 6 is provided with a radial flange 16, which for assembly purposes is, of course, separated from the pressure ring 6. Extending through the flange 16 are guide pins 17 which are secured in the flange 3. A sliding movement of the flange 16 on the guide pins 17 is promoted by a bush 18 in the flange 16, a bush being provided for each guide pin. Compression springs 19, guided on guide pins 20, are located between the backing member 5 and the flange 16 at all four corners. The compression springs 19 retain the pressure ring 6 in the position illustrated in the lower half of FIG. 1, when the hydraulic fluid is not under pressure.

The pressure ring 6 has an inner surface which is made up of surface parts 21 and 22 having a sharp setting angle $\beta$ and of surface parts 23 and 24 having a wide setting angle $\alpha$. The surface parts 23 are located at the end face 25 of the pressure ring 6, whereas the surface part 24 is located substantially midway between the surface parts 21 and 22, so that the generatrices of the surface parts 21 and 22 are of substantially the same length.

Co-operating with the surface parts 21 to 24 are eight pressing tools 26 which are uniformly distributed along the periphery and which at their outer surfaces consist of complementary surface parts 27 and 28 having a wide generating angle $\alpha$ and of surface parts 29 and 30 having a sharp setting angle $\beta$. The surface part 27 is located at the end faces 31 of the pressing tools 26, whereas the surface part 28 is located approximately midway between the surface parts 29 and 30. The pressing tools 26 will have been produced from a suitably shaped ring by cutting out gaps 32 of such dimensions that the pressing tools 26 can be brought sufficiently close to each other as shown in FIG. 2.

As shown in FIG. 1, the pressing tools 26 are secured to the backing member 5 by way of radially extending dovetail guides 33 which consist of T-shaped recesses 34 and of complementary T-shaped side blocks 35 which are attached to the backing member 5 by screws. The axis of the radial press which coincides with the axis of the cylindrical outer surface of the workpiece, not illustrated, is designated by the letters A—A. It can be seen from FIG. 1 that the length of construction in the axial direction A—A is extremely small.

Figure 2:
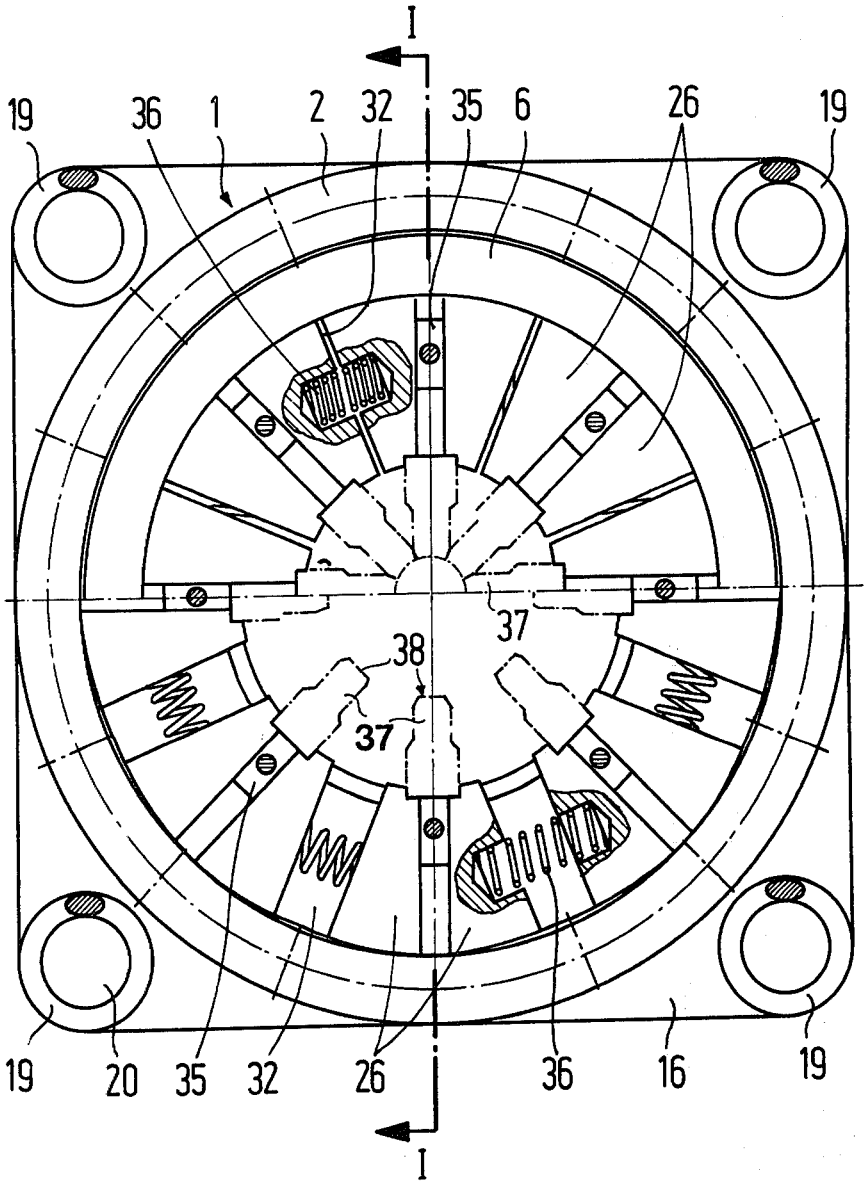
FIG. 2 shows a cross-section through the FIG. 1 press along the line II—II.

FIG. 2 shows the following further details. Between each pair of adjacent pressing tools 26 is fitted a return spring 36 designed as a compression spring whereby the pressing tools are moved radially outwards as far as is permitted by the position of the pressure ring 6. Fitted on each pressing tool is a tool attachment 37 having end face 38, shown in dash-dot lines; these attachments are replaceable and are adapted to the size and shape of the workpiece. It is however possible to form each tool 26 and attachment 37 in a single piece.

The mode of operation of the apparatus shown in FIGS. 1 and 2 is as follows:

Initially the pressure ring 6 is in the position illustrated in the lower half of the FIGS. and bears against the flange 3 under the action of the compression springs 19. The pressing tools 26 are then in their extreme outer position in which the gaps 32 between each pair of pressing tools are of maximum width because of the action of the return springs 36. In this position, a pressure hose with a fitting of complicated shape can be readily introduced into the cylindrical gap between the tool attachments 37, this gap forming, as it were, the envelope surface of the end faces 38 of the tool attachments 37.

If the pressure-medium drive now sets up line pressure in the bore 13, this pressure also acts on the annular surface 9 and begins to displace the pressure ring 6 to the left. As this happens, the surface parts 23 and 28 having a wide setting angle $\alpha$ then become effective as do the surface parts 24 and 27 if required. Expediently, the surface parts 24 and 27 are stepped from each other to a somewhat greater extent, so that contact between the surface parts 23 and 28 occurs. As this happens, the pressing tools 26 move inwards at a high speed and practically under no power, and the stroke of the pressure ring 6 corresponds only to the axial gap between the inner edge and the outer edge of the surface part 23.

Following this, the surface parts 21 and 22 of the pressure ring 6, which have a sharp setting angle $\beta$, start to co-operate with the complementary surface parts 29 and 30 as illustrated in the upper half of FIG. 1. When these surfaces begin to touch, or shortly thereafter, the actual power stroke occurs, i.e. a relatively long distance of travel of the pressure ring 6 is required to move the pressure tools 26 radially inwards to a corresponding extent. The end position of the pressure ring 6 and the pressing tools 26 is shown in the upper half of FIGS. 1 and 2. It can be seen, particularly from FIG. 2, that the end faces 38 of the tool attachments 37 here enclose a practically closed cylinder which corresponds to the final dimensions of the workpiece, not illustrated. The spaces 32 between adjacent pairs of pressing tools 26 have thus been reduced to narrow gaps.

As soon as the pressure in the drive 15 slackens off, the pressure ring 6 returns to the position illustrated in the lower half of FIG. 1 under the action of the compression springs 19, and the pressing tools 26 follow up the pressure ring under the action of the return springs 36. Because of the shape, as proposed in the invention, of the inner surface of the pressure ring 6 as well as of the outer surfaces of the pressing tools 26, the setting angles of these surfaces are ideally suited to the power requirements for the pressing tools. This is seen by plotting the radial pressing force against the stroke of the pressure ring 6 since the graph so obtained exhibits a sudden change in direction.

The subject-matter of the invention is not limited to the arrangement illustrated, in which the pressure ring and the hydraulic piston are one and the same component, and which is characterized by a particularly compact construction in the axial direction. It is readily possible to provide an external piston drive, and to connect the piston and/or cylinder to the pressure ring by way of distance pieces such as rods, or a pressure sleeve.

Figure 3:
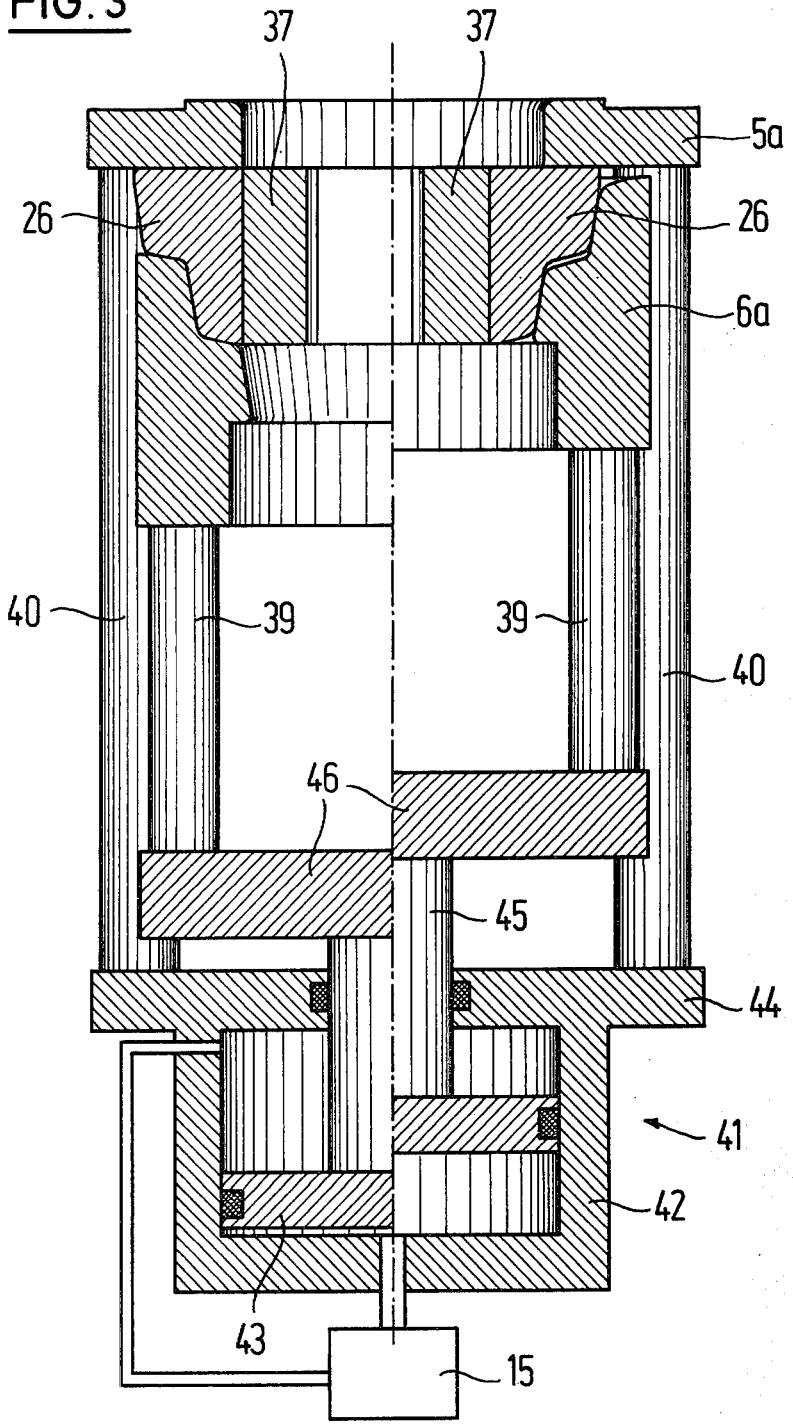
FIG. 3 is a section along the axis of a complete radial press similar to that shown in FIG. 1, but differing therefrom in that the functions of the pressure ring and the drive piston are separated.

A modified arrangement of this kind is illustrated in FIG. 3. The pressure ring 6a illustrated therein has, over its inner surface, the same geometrical shape as the pressure ring 6 shown in FIGS. 1 and 2; consequently, it is provided with the same form of pressing tools 26 as in the preceding Figures. Therefore, for the sake of clarity, the individual surface parts of the pressure ring 6a and pressure tools 26 have not again been provided with reference numerals. The important difference resides in the fact that the pressure ring 6a is not formed as a hollow piston. Instead, the backing member 5a and the pressure ring 6a are connected by distance pieces 39 and 40 to a piston drive 41 which consists of a cylinder 42 and a piston 43. The cylinder 42 has an outer flange 44 which is connected to the backing member 5a by way of distance pieces 40 acting as tie rods. The piston 43 is connected by a piston rod 45 to a flange plate 46 which in turn is connected to the pressure ring 6a by distance pieces 39 acting as plunger rods.

Figure 4:
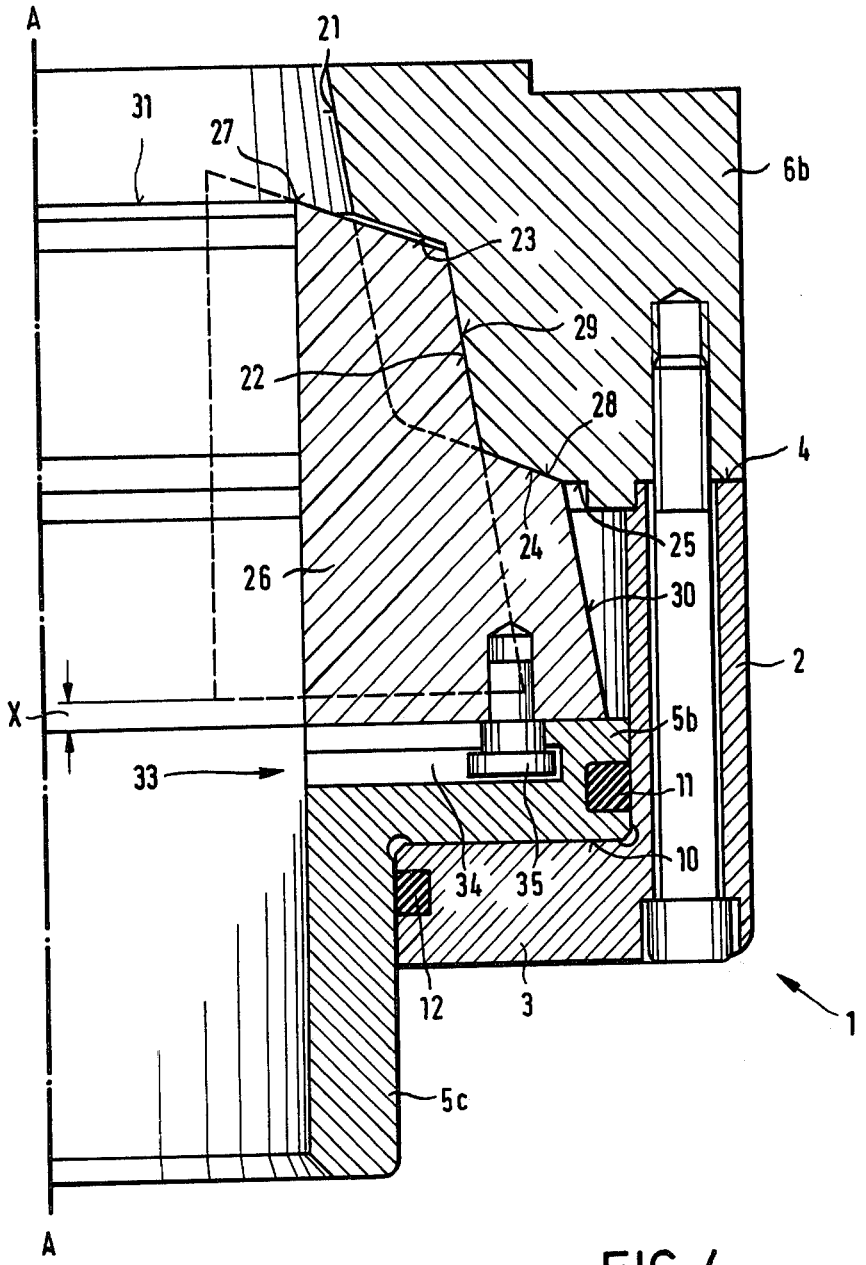
FIG. 4 is a half-section along the axis through a radial press in which the backing member is part of a hollow piston.

FIG. 4 shows a modified form of the system illustrated in FIGS. 1 and 3. In the FIG. 4 arrangement the principles of the construction and action have been reversed. However, where parts that are the same as those in FIGS. 1 and 3 are used, the previous reference numerals have been retained. Here again the cylinder 1 consists of a cylindrical body 2 and a radial flange 3. Here however, at that end face 4 remote from the flange 3, is secured the pressure ring 6*b*; the surface parts 21/22 and 23/24 correspond to those of FIG. 1 as regards position and setting angle.

Provided within the cylinder 1 is an axially symmetrical backing member **5*b* which is connected to a hollow cylinder 5*c*. The two parts form an annular piston, which, together with the flange 3, delimit a cylindrical space 10, the volume of which is zero in the end position illustrated. The surfaces of contact between the cylinder body 2 and the backing member 5*b* are of the same cylindrical form as the surfaces of contact between the flange 3 and the hollow cylinder 5*c*. Two O-rings 11 and 12** seal off the system against the exterior.

A plurality of pressing tools 26 uniformly distributed along the circumference co-operate with the surface parts 21 to 24, these tools having on their outer surfaces complementary surface parts 27 to 30 as in FIG. 1. As shown in FIG. 4, the pressing tools 26, only one of which is illustrated, are secured to the backing member **5*b* by way of radial dovetail guides 33 which consist of T-shaped recesses 34 and of complementary T-shaped slide blocks 35 which are secured to the pressing tools 26** by screws. The axis of the system is again designated by the letters A—A.

The mode of operation of the apparatus of FIG. 4 is as follows:

Initially, the backing member **5*b* is in the illustrated position in which the pressing tools 26 are in the extreme outer position indicated by shading. In this position a pressure hose and a fitting of complicated shape can be readily inserted into the cylindrical space defined by the pressing tools. Then, as soon as pressure is set up in the cylindrical space 10, this pressure acts on the annular face of the piston-like backing member 5*b* and begins to move it outwardly towards the pressure ring 6*b*. As this happens, the surface parts 24 and 28 having a wide setting angle then become effective as do the surface parts 23 and 27 if required. During this phase, the pressing tools 26 move inwards at high speed and virtually without applying force, the stroke of the backing member 5*b* corresponding only to the axial distance x. This distance corresponds to the axial distance between the inner edge and outer edge of the surface parts 24 and 28. On completion of this stroke, all the pressing tools 26** will have reached the position shown in broken lines.

Thereafter, the surface parts 21 and 22 of the pressure ring **6*b* that have a sharp setting angle begin to co-operate with the complementary surface parts 29 and 30, starting from the position shown by the broken lines. The actual power stroke occurs at this instant, i.e. a relatively long distance of travel of the backing member 5*b* is required in order to move the pressing tools 26 radially inwards to a corresponding extent. As soon as the pressure in the cylindrical space 10 slackens off, the backing member 5*b*** returns to the illustrated position under the action of compression springs, not illustrated.

I claim:

1. A radial press for workpieces with cylindrical outer surfaces, comprising: a plurality of pressing jaws arranged in a circle for radial movement toward the axis of a workpiece outer surface, each jaw having outer surfaces, composed of surface parts, whose generatrices extend at two different angles other than 90 degrees relative to the axis of a workpiece; a pressure ring having an inner surface composed of surface parts, the generatrices of which extend at two different angles other than 90 degrees relative to the axis, the inner surface of the pressure ring configured to be cooperative with the outer surfaces of the jaws; means for axially displacing the pressure ring to effect movement of the jaws; wherein both the pressure ring and the pressing jaws each have two surface parts having a wide setting angle and two surface parts having a narrow setting angle, the surface parts having a wide setting angle being disposed, firstly, at end faces and, secondly, between the surface parts having the narrow setting angle, wherein the generatrices are of substantially equal length and the surface parts which cooperate with each other are substantially complementary to each other, whereby when the pressing jaws are closed, surface parts having a wide setting angle are deployed first, and then the surface parts having a narrow setting angle are deployed.

2. A radial press according to claim 1, wherein the surface parts have conical surfaces.

3. A radial press according to claim 1, further comprising an axial backing member and dovetail guides joining the pressing jaws to the axial backing member.

4. A radial press according to claim 3, wherein the pressure ring comprises an annular piston surrounded by an annular cylinder to which the axial backing member is secured in the closing direction of the pressure ring.

5. A radial press according to claim 4, further comprising axial guide pins joining the pressure ring to the cylinder.

6. A radial press according to claim 1, wherein the wide setting angle is betweeen 70 and 80 degrees, preferably approximately 75 degrees, and the narrow setting angle is between 5 and 15 degrees, preferably approximately 10 degrees relative to the axis.

7. A radial press according to claim 3, wherein the displacing means comprises a piston drive connected to the backing member and the pressure ring by distance pieces.

8. A radial press according to claim 3, wherein the backing member comprises an annular piston surrounded by an annular cylinder to which the pressure ring is secured in the closing direction of the annular piston.

* * * * *